US005522210A

United States Patent [19]

Mack

[11] Patent Number: 5,522,210

[45] Date of Patent: Jun. 4, 1996

[54] FLYER FRAME

[75] Inventor: Karl-Heinz Mack, Weilheim, Germany

[73] Assignee: Zinser Textilmaschinen GmbH, Ebersbach/Fils, Germany

[21] Appl. No.: 395,061

[22] Filed: Feb. 27, 1995

[30] Foreign Application Priority Data

Feb. 28, 1994 [DE] Germany ..... 44 06 488.8

[51] Int. Cl.[6] ..... D01H 9/00; D01H 9/10

[52] U.S. Cl. ..... 57/281; 57/67; 57/90; 57/267; 57/273

[58] Field of Search ..... 242/35.5 A; 57/266, 57/267, 268, 270, 273, 274, 281, 90, 67

[56] References Cited

U.S. PATENT DOCUMENTS 5,375,405 12/1994 Weeger ..... 57/67

FOREIGN PATENT DOCUMENTS

| | | | |
|---|---|---|---|
| 0023193 | 1/1981 | European Pat. Off. . | |
| 0031844 | 7/1981 | European Pat. Off. . | |
| 2751264 | 6/1978 | Germany . | |
| 3936518 | 5/1991 | Germany | 242/35.5 A |
| 4229296 | 3/1994 | Germany . | |
| 4-352824 | 12/1992 | Japan | 57/267 |
| 81/00264 | 2/1981 | WIPO | 57/267 |

*Primary Examiner*—William Stryjewski
*Attorney, Agent, or Firm*—Herbert Dubno

[57] ABSTRACT

In a flyer frame, when the flyers are oriented transverse to the plane of their axes, segments of a track are linearly or angularly inserted through the spaces between the flyer arms to guide the trolleys of the carriages suspended from the resulting track adapted to take up the full bobbins and deliver the empty bobbin cores.

16 Claims, 8 Drawing Sheets

FIG. 10a
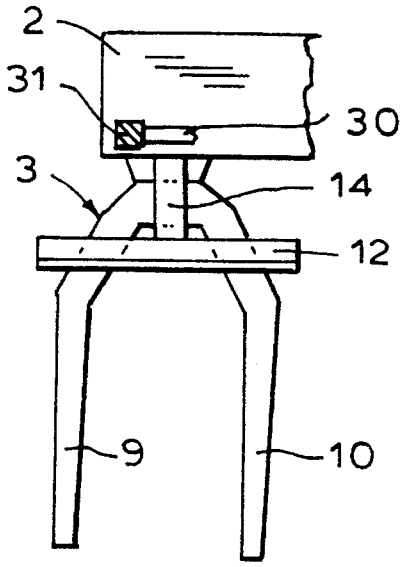
FIG. 10b
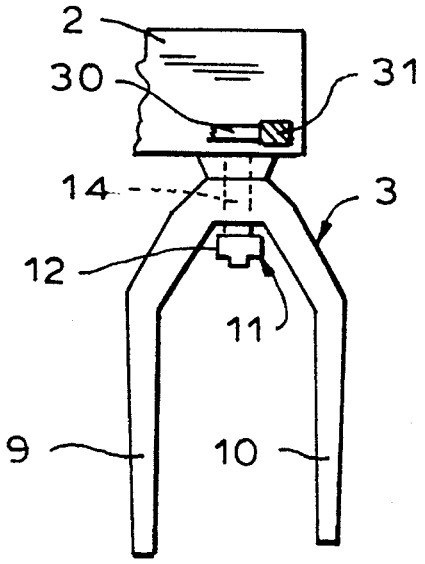
FIG. 11a
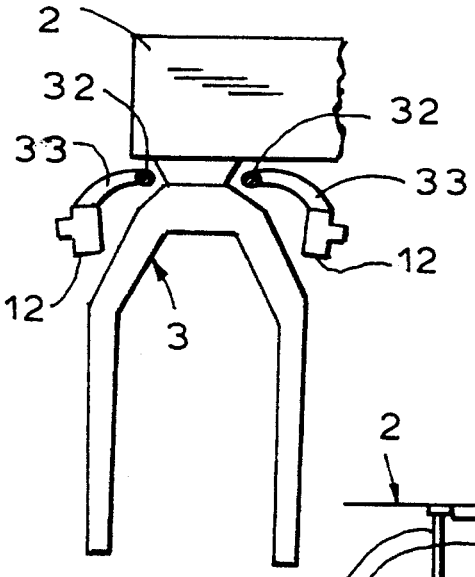
FIG. 11b
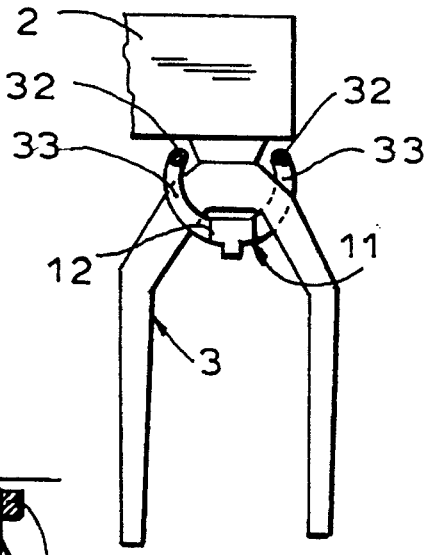
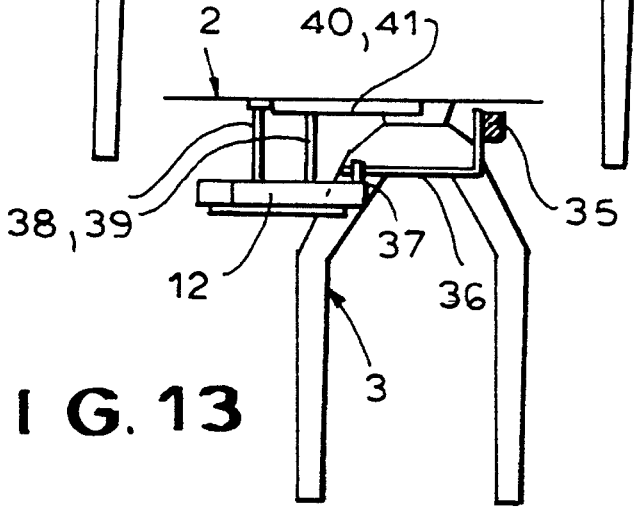
FIG. 13

FLYER FRAME

CROSS REFERENCE TO RELATED APPLICATION

This application is related to the concurrently filed copending application Ser. No. (08/394,841) (Attorney's docket number 19536) based upon German Patent Document 44 06 486.1 filed Feb. 28, 1994 and disclosing a chain of hanger carriages utilized in the doffing of fully wound bobbins and their replacement by Empty bobbin sleeves or tubes in a flyer frame.

FIELD OF THE INVENTION

The present invention relates to a flyer frame having a flyer rail on which at least one row of flyers is mounted, the flyers being rotatable about respective vertical axes, preferably above the spindles upon which empty bobbin tubes or sleeves can be placed so that roving bobbins can be wound thereon. The invention is particularly concerned with a flyer frame having means for the automatic replacement of fully wound bobbins by the empty tubes utilizing a chain of carriages provided with hangers on which the empty tubes and the fully wound bobbins can be supported for the automatic changing system.

BACKGROUND OF THE INVENTION

A flyer frame of the aforedescribed type is described in German Patent Document DE 39 36 518 A1, having a carriage chain which is disposed substantially at the same height as the flyer rail and is located rearwardly thereof. For the replacement of fully wound roving bobbins with empty bobbin tubes, the bobbin rail must be displaced from its working position below the flyer rail to a region behind the latter to cooperate with the carriage chain to which the fully wound bobbins are transferred and from which the empty bobbin tubes are received by appropriate vertical movement.

Since the shifting of the bobbin rail requires a massive operation, because the spindle rail carrying the bobbins also contain the spindle drive mechanism, the mass which has to be shifted is considerable and the apparatus must be highly complex and is of high construction cost. The special requirements of the machine are considerable because space must be provided to allow for shifting of the spindle rail and the bracing of the machine must be increased to carry the load of this spindle rail and the full bobbins rearwardly of the normal location. The flyer rail may then project away from the plane of the center of the machine almost twice as far as is customary and is desirable, thereby exposing the flyer rail and the machine to excessive vibration and stress.

Another arrangement utilizing a guide for a carriage chain adapted to receive the fully wound bobbin and to bring the empty tubes into position for placing upon the spindle is described in EP 0 031 844. This device can serve for the automatic doffing of the full bobbin and application of the empty bobbin tubes in a flyer frame by laterally swinging the flyers to provide a space which from above will afford access to the lowering mechanism having the suspended holders for the empty bobbin tubes and adapted to receive the fully wound bobbin.

This mechanism, again, is costly and frequently is unreliable.

Reference may also be made to German Patent Document DE 27 51 264 which discloses another device to facilitate the doffing of full bobbins from a spindle rail.

In this case, the flyers are provided at the undersides of their heads or yokes with spring clips which can engage in grooves at the upper ends of the roving tubes or sleeves. The tubes or sleeves can be engaged in these clips which serve to draw the full bobbins from the respective spindles when the spindle rail, after engagement of the fully wound tubes, is lowered. The fully wound bobbins must, however, be removed by hand in this system. The system also does not provide for any automatic means for placing the empty tubes on the spindle. Another drawback of this system is that special bobbin tubes are required because of the need for the aforementioned groove at the upper end.

In EP 0 023 193, still another system is described which provides on the underside of the flyer rail of a flyer frame grippers which are swingable into space between arms of the flyers and can engage the upper ends of the fully wound bobbins. These grippers then swing the fully wound bobbin out of the flyers as part of the doffing operation. Hereto, the bobbins must be removed by hand and further manipulated.

OBJECTS OF THE INVENTION

It is the principal object of the present invention, therefore, to provide an improved flyer frame for a system for the automatic doffing of fully wound bobbins and the mounting of empty bobbin tubes on the spindles whereby the aforedescribed drawbacks are avoided and, in particular, the use of a carriage chain with hangers engaging the fully wound bobbins and empty tubes is facilitated.

A more specific object is to provide a flyer frame with a bobbin change mechanism utilizing a carriage chain having such hangers but without the need to swing the flyers out of their normal frame and without the need to shift the spindle rail or the fully wound bobbins from their normal winding positions to enable the replacement of the fully wound bobbins by the empty tubes.

Yet another object of the invention is to provide a flyer frame for the production of roving bobbins which has a simplified guide for the carriage chain on which the fully wound bobbins are to be mounted and which brings the empty bobbin tubes into position for transfer to the spindles.

SUMMARY OF THE INVENTION

These objects and others which will become apparent hereinafter are attained in accordance with the invention in a flyer frame in which the guide means for the carriage chain on which the fully wound bobbins are to be mounted and from which the empty bobbin spools or tubes are to be placed upon the spindles can be supplied, is comprised of a multiplicity of track segments which are displaced into spaces between the arms of the flyers upon orientation of these flyers into positions generally transverse to the longitudinal dimension of the machine. Thus a continuous track is formed through the interiors of the flyers on which the carriage chain can be guided and from which the carriage chain can be suspended.

The rail segments are thus movably mounted on a stationary part of the machine, e.g., the flyer rail or a part of the machine frame carrying the frame rail.

This system thus provides the advantage that the guide is not formed by the flyers themselves and thus that it is not necessary to provide the rail segments on the rail flyer or otherwise increase the mass thereof, a particular problem when the flyers are driven at extremely high speeds. Furthermore, the rail which is formed has a minimum of interruptions or gaps and thus can guide the carriage chain with a high degree of reliability. Since the carriage chain is located in the plane of the spindles and hence of the fully wound bobbins, excess movement of the bobbins or empty tubes is eliminated.

The net result is a substantial reduction in the doffing time.

According to the invention, therefore, one rail segment can be provided ahead of the first flyer, a rail segment can be provided between each successful pair of flyers and a rail segment can be provided behind the last flyer of each row of flyers of the machine. The rail profiles of the segments is so formed that they can be swung into end to end alignment, linearly shifted into end to end alignment transverse to the plane of the axes of the flyers, or rotated so that successive segments are aligned with one another. The segments can practically abut in their end to end relationship substantially at the axes of the flyers. They can form an open rail profile for support rollers in the form of external rollers or can form a profile, in which case the support rollers are located within the rail (see the aforementioned copending application).

The profiles of the rail segments can be generally parllelogrammatic in plan view, i.e. the parts which substantially met in end to end relationship can be bevelled. The gap between the ends of the aligned track segments can be extremely small, providing a practically continuous path as a guide for trolleys from which the carriages are suspended. The bevelled junctions between ends of the aligned segments ensure a rolling of the trolleys over these junctions without any impact or disturbance as a result of the gap because the segments effectively overlap along the trolley path.

According to a feature of the invention, the segments are provided with height aligning means to insure that each end of each segment will lie at the same height as the end of a successive segment. The height positioning elements can be provided on the ends of the segments.

The flyers can have configurations and orientations so that they are not contracted by the flyers and so that only a minimum angular displacement is required to shift the track segments into the spaces between the arms of the flyers. The ends of the track segments can be tapered or rounded and the load applied to these ends can be minimized by the slight overlap of the adjacent segments.

Instead of a rotary movement of the segments about a vertical or horizontal axis, it is also possible to shift the rail segments linearly or along a curved line into position. In this case it is advantageous to vary the angular positions of the flyers to enable the insertion of the track segments into the spaces between their arms. As soon as the track segments are in position, i.e. aligned to form the linear guide for the trolleys carrying the carriage chain, the flyers can be rotated into the position best suited for the doffing operation, i.e. into planes perpendicular to the longitudinal plane of the flyer frame. In the latter case, the greatest open space is provided between the arms of each flyer for passage of the carriage chain.

A flyer frame according to the invention can thus comprise:

an elongated machine support;

at least one row of flyers on the support, the row extending in a line along the support, the flyers of the row being rotatable about respective generally vertical axes and having diametrically opposite downwardly extending generally coplanar arms defining a space between them;

a multiplicity of track segments mounted on the support;

means on the support connected to the track segments for introducing the segments into the spaces upon orientation of the flyers with respective planes of the arms transverse to the line, thereby aligning the segments end to end to form a guide extending through the spaces; and a chain of carriages riding upon and depending from the guide and formed with means engageable with empty bobbin tubes and fully wound bobbins for doffing wound bobbins of the machine and replacing doffed bobbins with empty bobbin tubes.

Advantageously, the vertical axes of the track segments, when they are rotatable about vertical axes, lie in a common plane with the vertical axes of the flyers. The vertical axis of each track segment can lie substantially midway between vertical axes of two successive flyers of the row.

Advantageously, aligned ends of successive track segments can be disposed substantially at respective vertical axes of the flyers.

Means can be provided for simultaneously displacing all of the segments mechanically into the guide-forming position or the position in which the segments are withdrawn from the spaces between the flyers.

BRIEF DESCRIPTION OF THE DRAWING

The above and other objects, features, and advantages will become more readily apparent from the following description, reference being made to the accompanying drawing in which.

Figure 2:
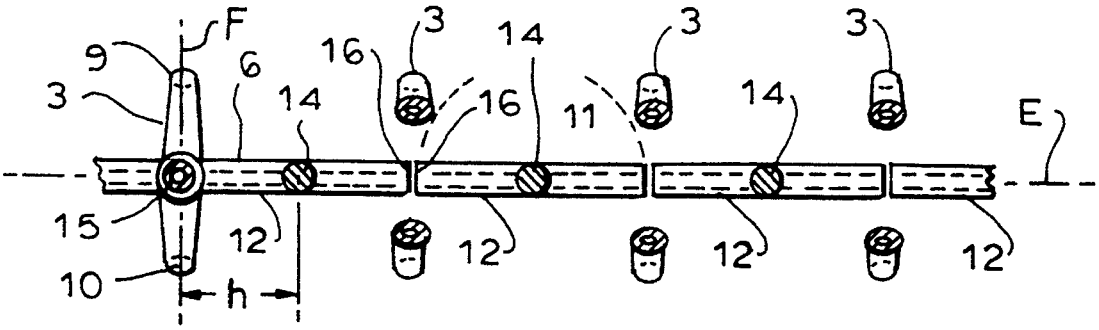
FIG. 2 is a diagrammatic plan view of the track for a suspended carriage chain with the flyers partly broken away.
Figure 4A:
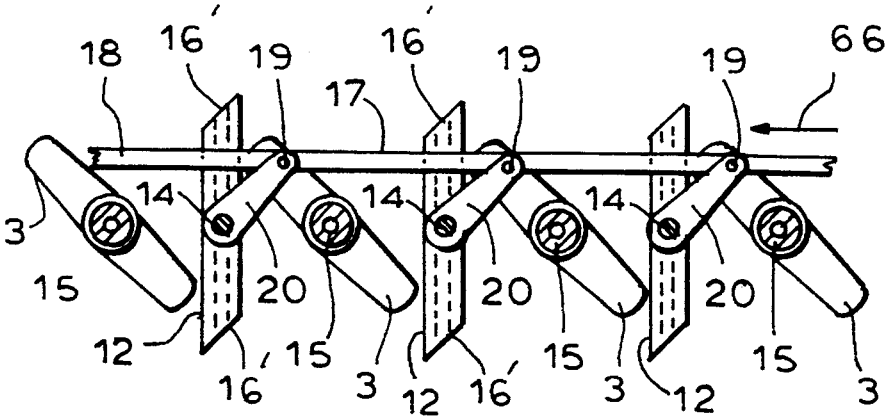
Figure 5:
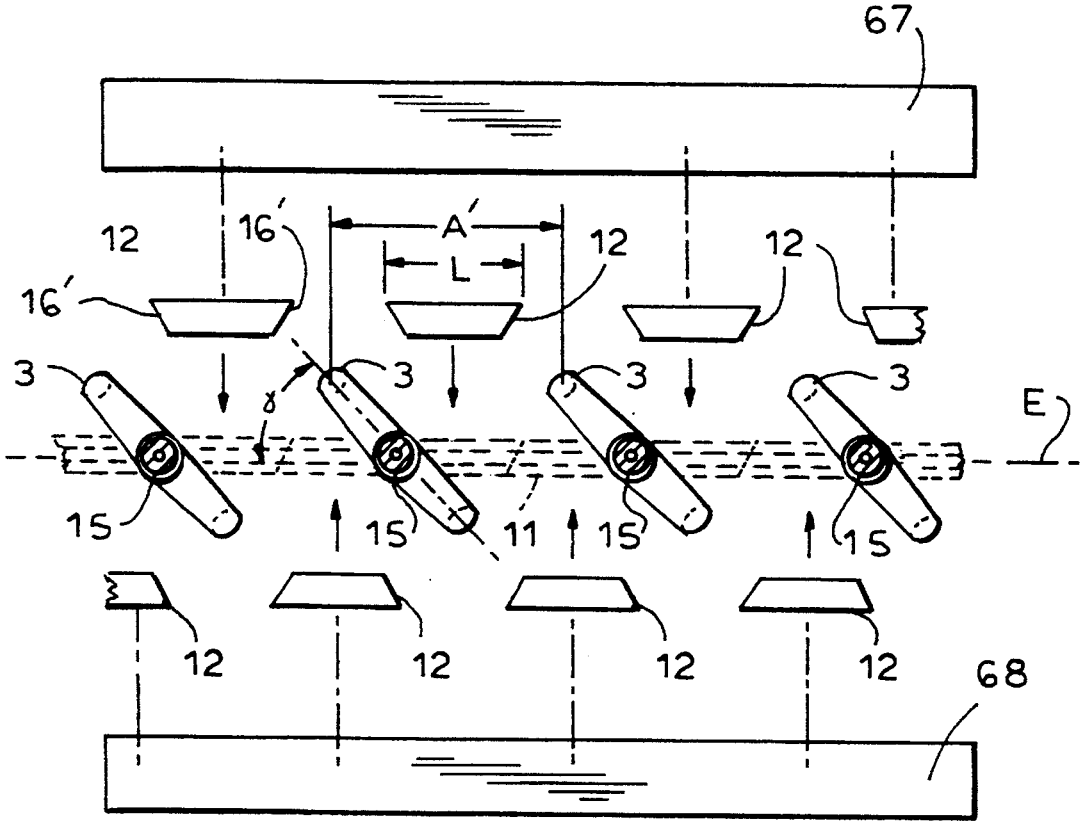
Figure 6A:
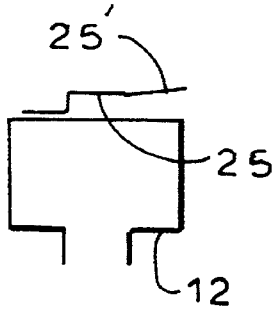
Figure 6B:
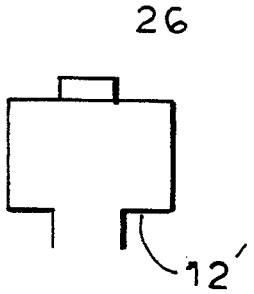

FIG. **4*a* is a view similar to FIG. 2** but showing a common drive for mechanically operating the track segments of a modified track system, the track segments being shown in their open position;

FIG. **4*b* is a view similar to FIG. 4*a*** with the track segments in their closed position, i.e. end to end, to form a continuous guide for the carriage chain;

FIG. 5 is a plan view of another embodiment of the invention utilizing linear shiftable track segments;

FIG. **6*a*** is a diagrammatic cross section illustrating one embodiment of a height levelling system for one track segment according to the invention;

FIG. **6*b* is a view similar to FIG. 6*a* showing the track segment cooperating with that of FIG. 6*a;***

Figure 3:
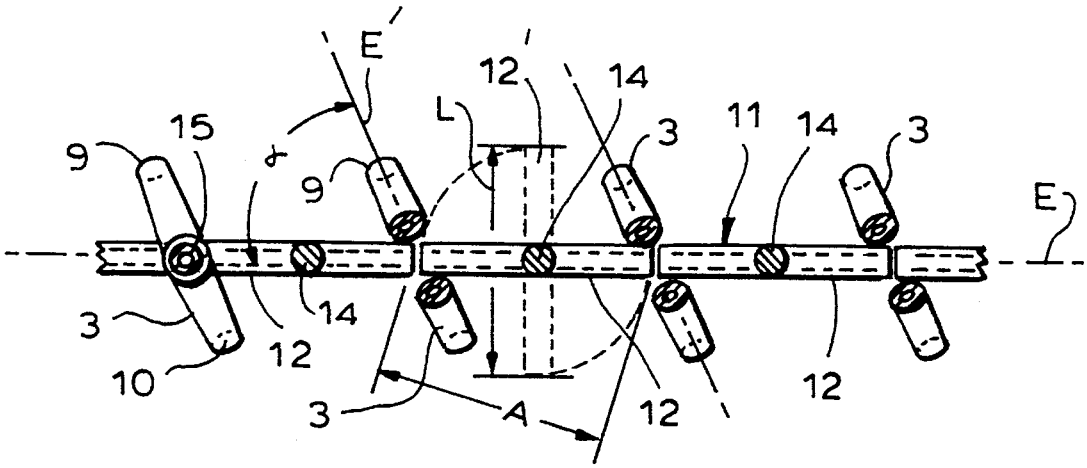
FIG. 3 is a view similar to FIG. 2 with the flyers shown in another position.
Figure 7:
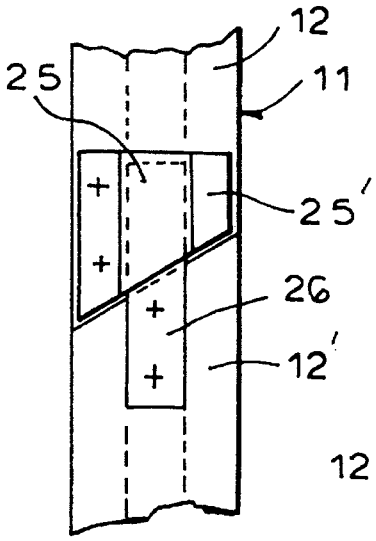
Figure 8:
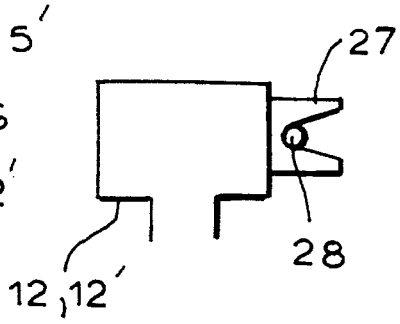
Figure 9:
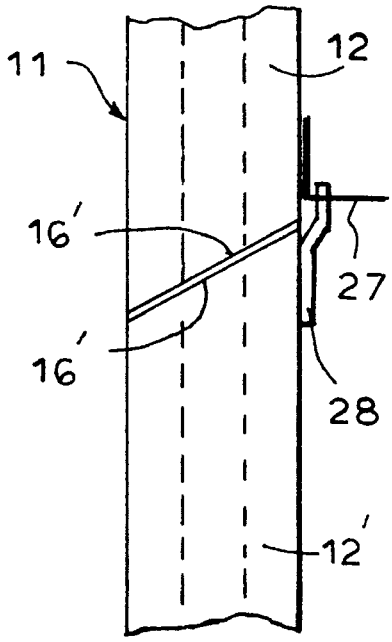
Figure 12A:
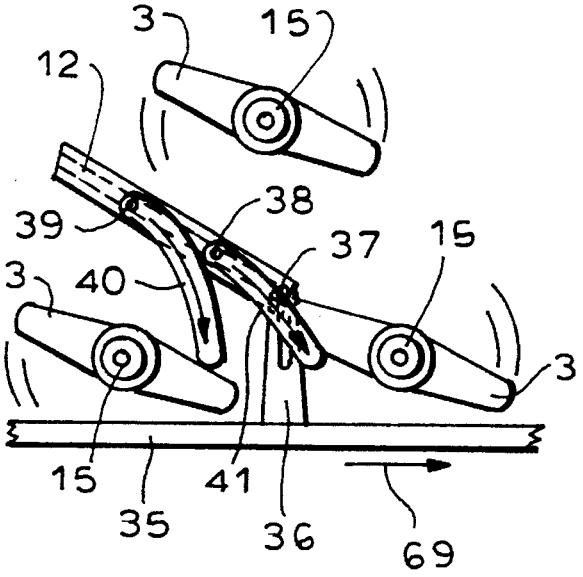
Figure 12B:
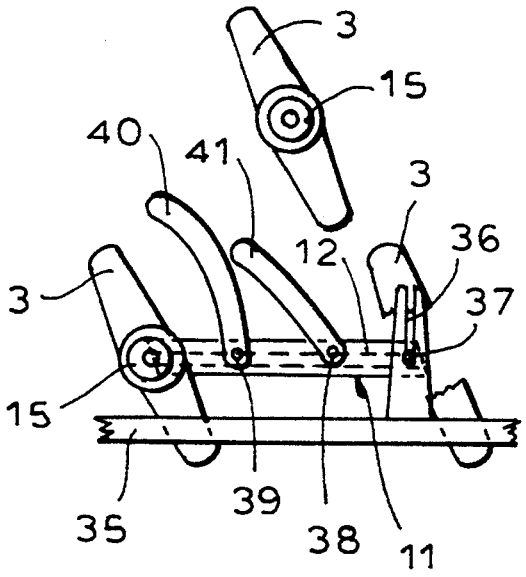

FIG. 7 is a plan view of the two track segments of FIGS. **6*a* and 6*b*** in end to end relationship;

FIG. 8 is a cross sectional view through a track segment showing another embodiment of a height levelling system;

FIG. 9 is a plan view analogous to that of FIG. 7 but illustrating the height levelling system of FIG. 8;

FIGS. **10*a* and 10*b* are side views of the embodiment of FIGS. 2 and 3** in two different positions of the track segment;

FIGS. 11*a* and 11*b* are views similar to FIGS. 10*a* and 10*b* of a further embodiment also in two different positions of the track segment;

FIGS. 12*a* and 12*b* are plan views, partly broken away of yet another embodiment in two different positions;

FIG. 13 is a side view of one flyer showing the cooperation of a segment therewith in the system of FIGS. 12*a* and 12*b;*

Figure 14:
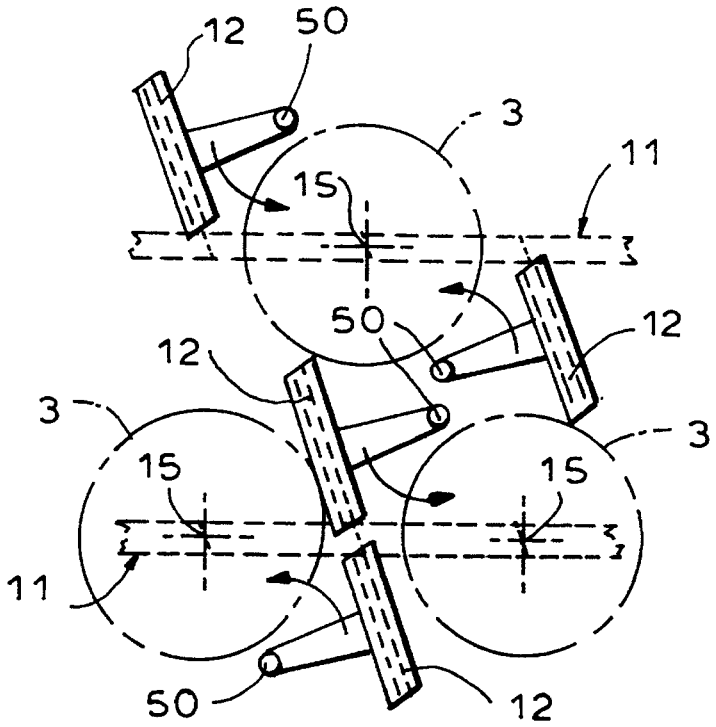
Figure 15A:
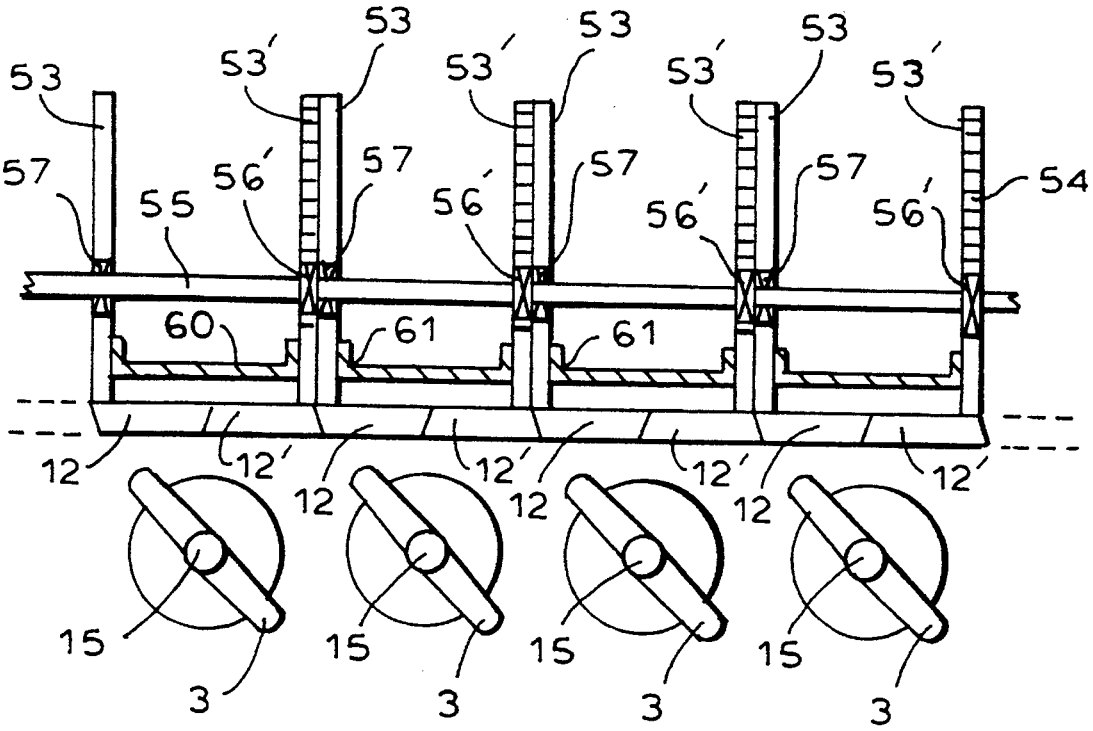

FIG. 14 is a plan view of yet another embodiment in open positions of the track segments; and FIGS. 15*a,* 15*b,* 15*c,* and 15*d* are plan views of yet another embodiment showing a number of different positions of the track segments thereof.

SPECIFIC DESCRIPTION

Figure 1:
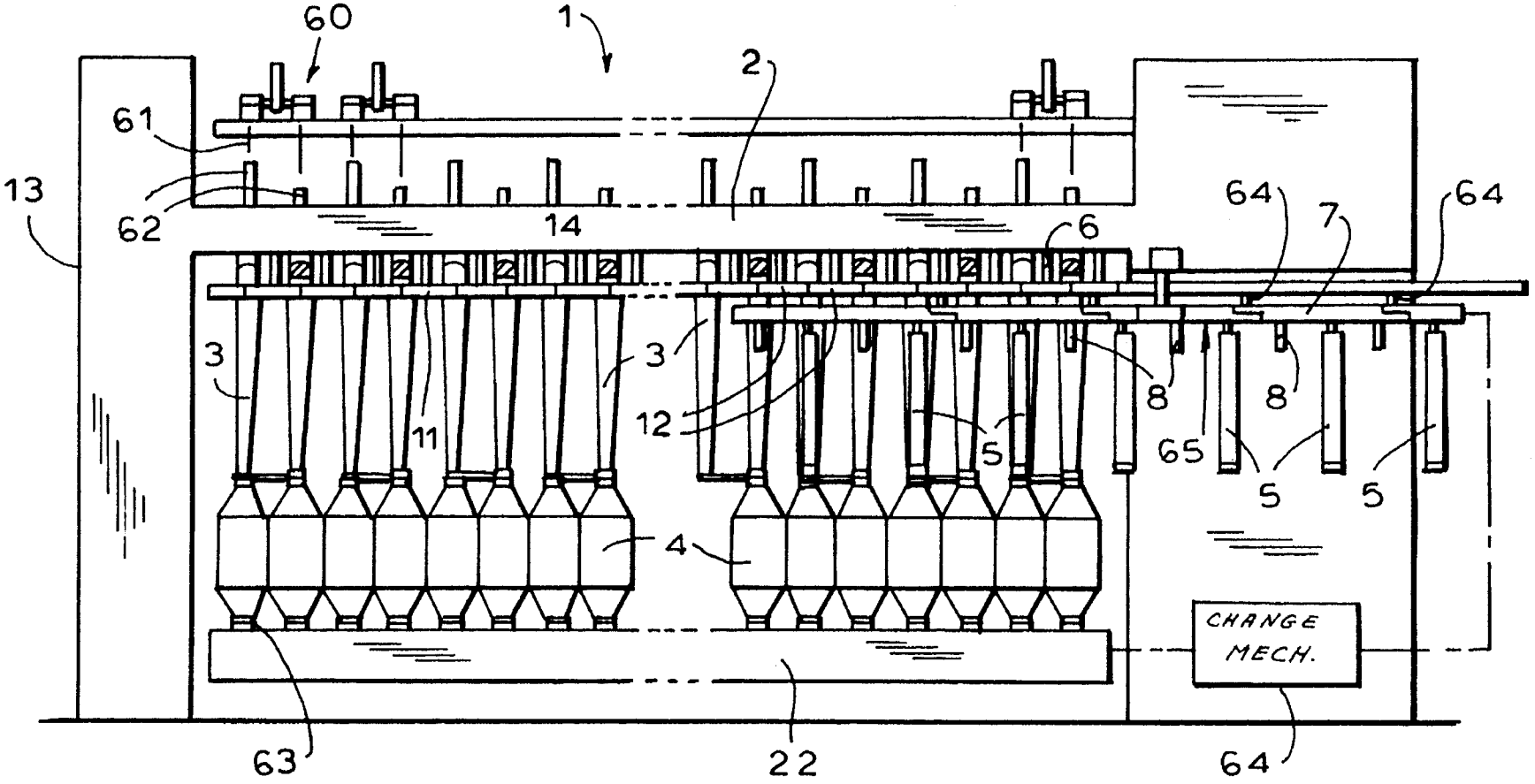
FIG. 1 is a side elevational view of a portion of a flyer frame for the winding of a roving bobbin onto a bobbin tube to form a roving bobbin at each of a multiplicity of spindles, the flyers arms being partly broken away.

The flyer frame disclosed in FIG. 1, except for the features specific to the present invention, is of conventional construction. It comprises the usual drafting frame 60 with respective stations feeding sliver at 61 to guide tubes 62 feeding the stretched sliver to the flyers 3 displaceable about respective vertical axes on a flyer rail 2 forming part of a machine frame 13 which is elongated parallel to the plane of the paper in FIG. 1 and can have two rows of flyers extending in the longitudinal direction. The roving formed by the rotation of the flyers 3 passes through one arm of each flyer and is guided by the conventional pressing finger, not shown, onto a respective roving bobbin 4 which is wound on a bobbin core, sleeve or tube 5. For that purpose, the tubes 5 can be placed on spindles 63 of a spindle rail 22, the axes of the spindles 63 being aligned with the vertical axes of the respective flyers.

For automatic bobbin change, a bobbin change mechanism 64 can be provided for lifting the spindle rail 22 to lodge the bobbins 4 on hangers 8 of a carriage chain whose carriages 7 are linked together end to end at 64, or this chain can be lowered for that purpose or a vertical movement of the bobbins and the empty tubes 5 to be substituted for them can be accomplished by other means known in the art and not per sea part of this invention.

Suffice it to say that the carriage chain formed by the carriages 7 can be suspended from trolleys riding in a guide or track 6. The carriages, trolleys and hangers are the subject of the above-identified copending application which is hereby incorporated by reference in its entirety.

During the normal working phase, the bobbins 4 are wound on the core tubes 5. At the end of this portion of the operating cycle, the flyers 3 are rotated into positions in which they are perpendicular to the longitudinal, i.e. the planes of the flyer arms are perpendicular to the plane of the paper in FIG. 1 and to the vertical plane of the axes of the flyers and the spindles and the bobbin rail 22 is lowered to its lowest position.

From the right side, a suspended carriage chain 65 of the carriages 7 is inserted along the track 6 and has hangers 8 which are alternatively free and provide with empty tubes 5. The carriage chain 7 can be displaced by one or more pairs of motor driven wheels (not shown) engaging the carriages between them. The trolleys of the carriages support the chain on the guide or track 6 which passes through the spaces between the arms 9 and 10 (FIG. 2) of the flyers 3 of the respective row of flyers all oriented perpendicular to the longitudinal direction. The track within the flyer row has been illustrated at 11 in FIGS. 1 and 2 and is composed of individual rail or track segments 12 which are movably mounted on the machine frame 13 and/or the flyer rail 2 and in the position shown in FIGS. 1 and 2 are aligned with one another end to end.

In the embodiment of FIG. 2, each of the rail segments 12 is mounted to rotate about a vertical axis 14 on the flyer rail 2. The axes 14 lie in the same plane as the vertical axes of the flyers of the respective row parallel to the longitudinal dimension of the machine and at a spacing corresponding to the spacing between the axes 15 of the flyers 3, substantially midway between them. The common plane of these axes has been represented at E in FIG. 2 and the spacing of each axis 14 from the axes of the two flyers between which the respective segment is mounted has been represented at h.

In the embodiment of FIG. 2, the ends 16 of the track segments 12 are seen to be rounded. The flyers arms 9, 10 of the flyers 3 lie in respective flyer planes F perpendicular to the plane E in the doffing position.

Once the segments have aligned with one another, the ends 16 of successive segments 12 in end to end relationship lie in the regions of the axes 15 of the flyers 3. The segments can be rotated through about 90° about their axes 14 our of the spaces between the arms 9, 10 by a common mechanism drive not shown in this Fig.

The broken line in FIG. 3 represents the path of the ends of the segments 12. As a consequence, the track 11 must be lowered so that the swinging movement of the segments is not intercepted by the flyer arms or vice versa. When the flyer has arms which incline toward one another upwardly toward the axis 15, the track 11 can be disposed somewhat higher when the flyers are displaced somewhat out of the perpendicular positions as shown, for example, in FIGS. 3 and 10. As will be apparent from FIG. 3, the path of the rail segment 12 does not collide with the flyer arms although the sectional plane in FIG. 3 is somewhat higher than in FIG. 2 as is apparent from the reduced spacing of the cut surfaces of the flyer in FIG. 3. In the embodiment of FIG. 3, the arms 9, 10 of the flyer lie in a plane E' which is somewhat inclined to the plane E of the axes 15 of the flyers 3.

In the embodiment of FIG. 3, the inclination of the respective plane E' to the plane E, i.e. the angle $\alpha$ can be about 60°. In that case, advantageously a space is provided in which the individual segments of the track 11 can better swing into alignment. The flyers 3 must be so positioned that the distance A between diagonally opposite flyer arms 10 of successive flyers in the region of the rail segment 12 is at least slightly greater than the length L of the track segment.

The positioning of the flyers can be carried out by hand or by manual triggering of the control circuitry or, as will be indicated, automatically. Modern flyer frames have a separate controllable drive for the flyers by means of which these can be driven in opposite directions and through the use of which, the flyers can be brought into predetermined angular positions. In this case, I can utilize such control circuitry to position the flyer automatically via the main machine control at the desired angle setting to cause the segments to be aligned through the spaces between the arms of flyers.

Figure 4B:
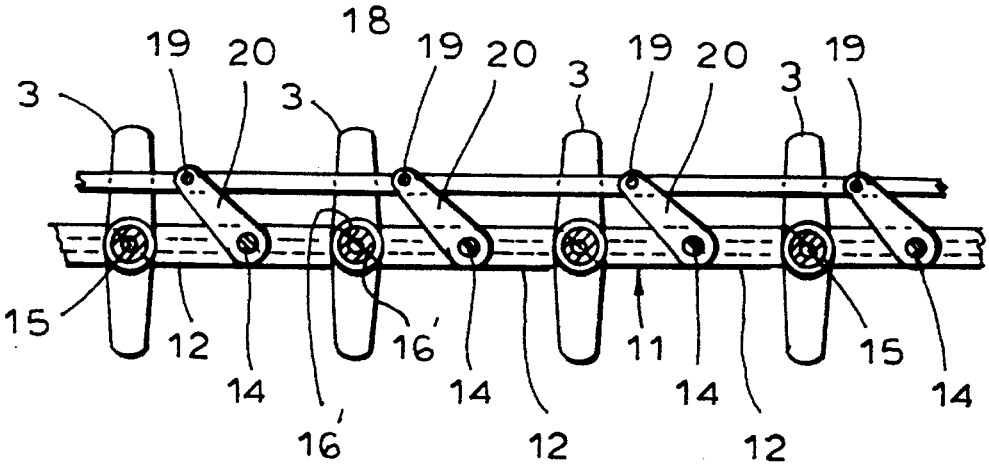

In FIGS. 4*a* and 4*b,* an embodiment has been illustrated in which a common mechanical drive 17 is provided for the rail segments 12. The segments 12 can have, as is clearly visible in FIG. 4*a,* bevelled ends 16' which can overlap (FIG. 4*b*) so that travel of the trolley over the end to end junctions can be effected without jolting.

The mechanical drive 17 can comprise a bar 18 connected by pivots 19 to swingable levers 20 which are angularly displaceable about the vertical axes 14 of the segments 12 to swing them in respective circular paths about these axes.

FIG. 4*a* shows the segments 12 in the open position.

When the bar 18 is shifted to the left (arrow 66), each of the segments 12 is swung from its open position shown in FIG. 4*a* in which it lies at right angles to the longitudinal dimension of the machine in the counter clockwise sense into the position shown in FIG. 4*b* wherein the segments 12 are closed on one another to constitute the continuous track 11 along which the suspension carriage chain 7 is displaceable as has been described in connection with FIG. 1. Because of the complementary bevels 16' at the abutting ends of the segments 12, the segments can be practically free from gaps from between them the overlap between the segments enabling travel of the trolleys without bumping over the junctions.

The embodiment of FIG. 5 utilizes segments 12 which are displaceable parallel to one another via a common actuator 67 or 68 (one shown for each side of the row of flyers 3), the bevels 16' of the mating ends of the flyers being likewise complementary to minimize impact on the trolleys passing over them. The closed rail is shown in broken lines at FIG. 5 and the segments are shown in solid lines in their open positions.

The lengths L of each track segments is here smaller than the distance A' between the neighboring flyers 3. So that the segments 12 can pass into the gaps between the flyers, such segments are provided in each gap and are inserted from opposite sides and the flyers 3 are positioned at an angle $\alpha$ to their respective planes, maximizing the spacing A' on each side. Of course, if it is necessary that the flyers lie perpendicular to the plane E for the insertion of the segments 12, these should be introduced linearly at an angle to the plane E, namely, the angle $\alpha$.

FIGS. 6*a*, 6*b*, 7 and 8 show various embodiments of a height levelling system between neighboring rail or track systems 12 or 12'. For example in FIG. 6*a* one end of a track segment is shown to be provided with a laterally also resilient tongue 25 with a convergence of that segment. The end of an adjoining segment is provided with a bar 26 engageable below the open end 25' of the tongue 25 to level the adjoining segments 12 and 12'. The overlapping bevelled ends of the segments 12 and 12' thus adjoining without any step in the vertical direction which may transfer with travel of the support rollers of the track 11.

FIGS. 8 and 9 show another height alignment system in which, for example, the track segment 12 has a lateral centering member 27 with a V-shaped notched in which a finger 28 of the adjoining segment 12' can engage. Here too, the bevels 16 and 16' can abut at the same height and without any step between them.

FIGS. 10 and 10*a* show an embodiment analogous to that of FIGS. 2 and 3 wherein the flyers 3 are rotatable on the flyer rail 2. In FIG. 10*a*, the track segment is swung into its open position about its vertical axis 14 on the rail 2. In FIG. 10*b*, a rack 31 has displaced the pinion 30 of the respective pivot shaft 14 to swing the track segment 12 into alignment with the row of flyers 3 to establish the continuous track 11.

The rack 31 can displace all of the pinions of all of the shafts 14 on the respective flyer rail 2.

FIGS. 11*a* and 11*b* illustrate another embodiment of the invention wherein the track segments 12 are swung into place from outside the plane of the axes of the flyers 3, rather than being shifted linearly as in the embodiment of FIG. 5. In this case, on the flyer rail 2, two pairs of shafts 32 are provided, the segments 12 alternating along the track 11 being swingably mounted by respective pivot arms 33 on the shafts 32. In FIG. 11*a*, the segments 12 are shown to be swung out of alignment while in FIG. 11*b* the segments are shown in the closed position defining the track 11. The segments are swung between the respective positions by shafts 32 which are keyed thereto.

In the embodiment of FIGS. 12*a* and 12*b*, a bar or rod 35 is linearly shiftable in the manner described in connection with FIGS. 4*a* and 4*b* but is connected via a pin 37 displaceable in a slide 36 of the bar 35 with the respective segment 12. Each segment 12 has pins 38 and 39 engaging in guides 40 and 41 on the respective rail 2 which orient the segments 12 in alignment in the position shown in FIG. 12*b*, but dispose these segments 12 out of the path of the flyer arms of the flyers 3 when the alignment of the track is not required and for the winding of the bobbins. The bar or rod 35 is slidable in the direction of the arrow 69 to align the segments 12 with one another.

FIG. 13 is a side view corresponding to FIGS. 12*a* and 12*b* from which it is clear that the guides 40 and 41 from which the pins 38 and 39 suspend each segment 12 are provided on the underside of the flyer rail 12 while the bar 35 is disposed above the flyers 3.

FIG. 14 shows an embodiment in which the individual segments 12 are swingable about axes 50 and can be displaced as shown by the arrows angularly into their mutual alignment to form a pair of parallel tracks 12 for the 2 rows of flyers.

In this embodiment the track segments are single about axes which do not lie in the planes of the flyer axes and which, of course, are outside the orbits of the flyer arms shown in dot dash lines in FIG. 14.

The vertical axes 14 and 50 can, as indicated in FIG. 1, be mounted on the underside of the flyer rail 2.

Alternatively, they can, as has been shown for the embodiment of FIGS. 10*a* and 10*b*, be journalled in the flyer rail. The shaft pair 32 and the slides 40 and 41 can also be disposed on the underside of the flyer rail or on a bracket of the frame 13 of the spinning machine which can extend below the flyer rail if desired.

Figure 15B:
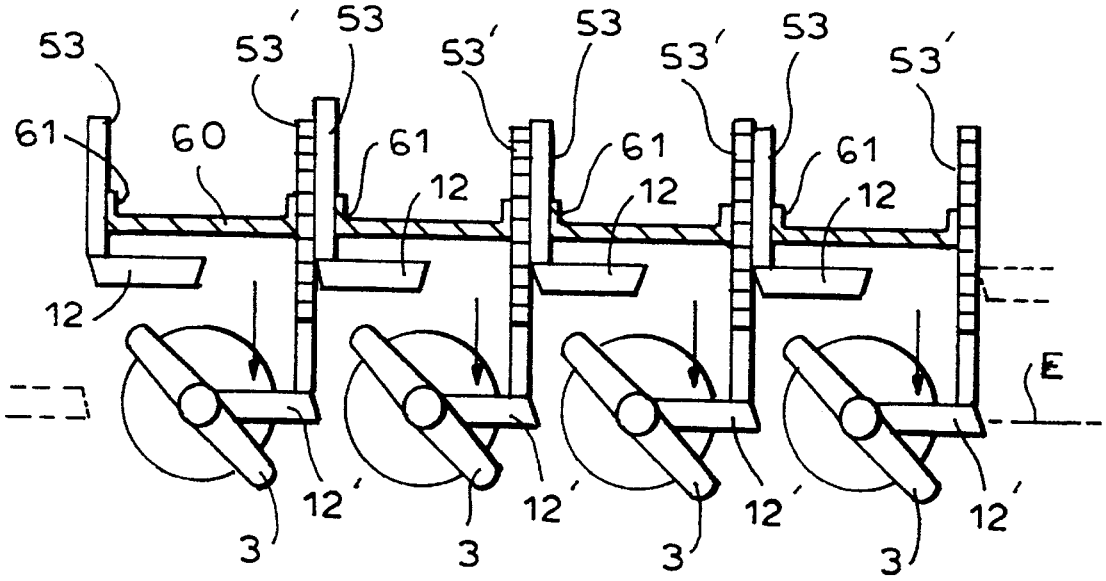
Figure 15C:
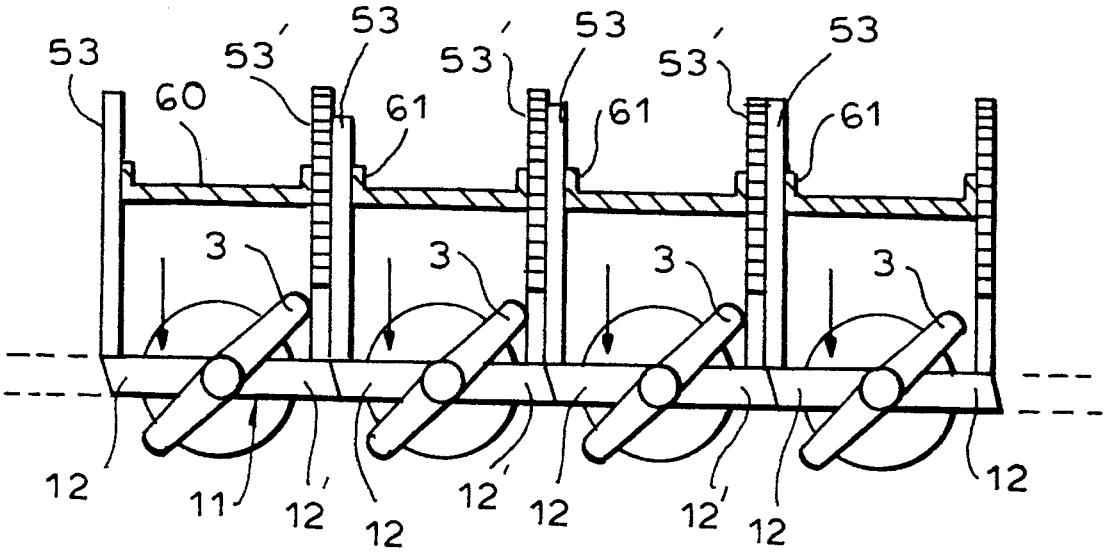

While, in the embodiment of FIG. 5, the individual rail segments are mounted on both sides of the row of flyers 3, in FIGS. 15*a* through 15*c*, the segments are all disposed on one side of the row of flyers 3 and are displaced into alignment within the row of flyers by first angularly positioning the flyers to permit alternating flyers to be inserted and then reversing the positions of the flyers to permit the remaining flyers to be inserted.

In this case, the rail segments 12 and 12' are carried by bars 53 and 53', respectively displaceable transverse to the plane of the flyer axes in guides 61 of a machine frame part 60, i.e. horizontally. The bars 33 form racks engaging the alternating segments 12 while the bars 53' carry the remaining segments 12'. The racks 53 and 53' are toothed on their undersides and their upper sides, respectively and engage pinions 56 and 57. The pinions 56 and 57 are driven by respective parallel shafts, the upper one of which is represented at 55. The upper shaft 55 carries the pinions 56 while the lower shaft, not visible, in FIG. 5*a* not engaging the teeth of racks 53.

Figure 15D:
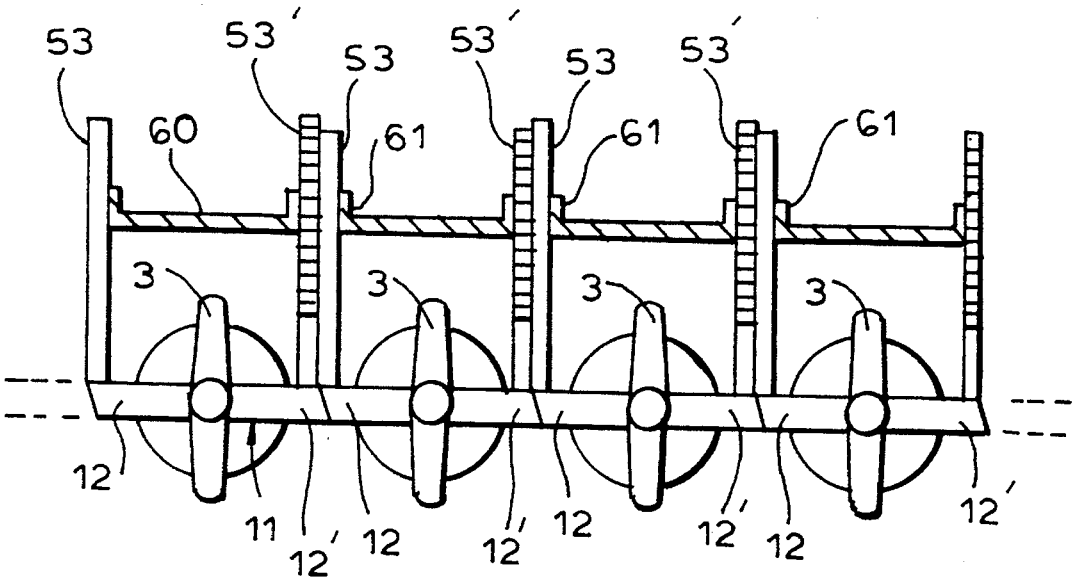

As can be seen from FIG. 15*b*, with the flyers 3 positioned at an inclination to the plane E of their axes, the segments 12' are inserted into the plane via the racks 53'. The flyers 3 are then displaced to the right and the segments 12 are inserted via and racks 53 (FIG. 15*c*) thereby aligning the segments to from the track 11. The flyers 3 can then be rotated to lie at a right angle to the plane (FIG. 15*d*) to position them in the doffing position. Utilizing the guide 6, in each of the embodiments once the segments are aligned, the suspension chain can be introduced through the track 11 with a high degree of reliability.

I claim:

1. A flyer frame comprising:

an elongated machine support;

at least one row of flyers on said support, said row extending in a line along said support, the flyers of said row being rotatable about respective generally vertical axes and having diametrically opposite downwardly extending generally coplanar arms defining a space between them;

a multiplicity of track segments mounted on said support;

means on said support connected to said track segments for introducing and removing said segments into said spaces upon orientation of said flyers with respective planes of said arms transverse to said line, thereby aligning said segments end to end to form a guide extending through said spaces; and a chain of carriages riding upon and from said guide and formed with means engageable with empty bobbin tubes and fully wound bobbins for doffing wound bobbins of the machine and replacing doffed bobbins with empty bobbin tubes.

2. The flyer frame defined in claim 1 wherein said track segments are pivotally mounted on said support.

3. The flyer defined in claim 2 wherein each of the track segments has the same length and is swingable about a respective vertical axis on said support.

4. The flyer frame defined in claim 3 wherein said vertical axes of said track segments lie in a common plane with said vertical axes of said flyers.

5. The flyer frame defined in claim 4 wherein the vertical axis of each of said segments lies substantially midway between vertical axes of two successive flyers of said row.

6. The flyer frame defined in claim 4 wherein aligned ends of successive track segments are disposed substantially at respective vertical axes of said flyers.

7. The flyer frame defined in claim 3 wherein said segments are constructed and arranged to collectively swing through up to 90° out of said spaces.

8. The flyer frame defined in claim 3 wherein, for introduction of said segments into said spaces, said flyers are swingable out of respective positions transverse to said line sufficiently that the clear distances between two oppositely disposed flyer arms of successive flyers, is greater than the length of the segment.

9. The flyer frame defined in claim 1 wherein aligned ends of successive track segments are rounded.

10. The flyer frame defined in claim 1 wherein said segments are shiftable transverse to a plane of said vertical axes into said plane and the segments have lengths less than distances between two successive flyers.

11. The flyer frame defined in claim 10 wherein said flyers are displaced angularly out of said plane by 45° to 90° for insertion of said segments into said spaces.

12. The flyer frame defined in claim 1 wherein the aligned ends of said segments are beveled.

13. The flyer frame defined in claim 1 wherein the aligned ends of said segments are provided with means for positioning one of each pair of aligned ends at the same height as the other end of the aligned pair.

14. The flyer frame defined in claim 1 wherein said means on said support connected to said track segments for introducing said segments into said spaces includes a common mechanism connected to said segments for mechanically displacing same.

15. The flyer frame defined in claim 1 wherein said flyers are journaled on a flyer rail extending longitudinally along said support, said segments being mounted on said flyer rail.

16. The flyer defined in claim 1 wherein said machine support includes a machine frame, said segments being mounted on said machine frame.

* * * * *